US009754525B2

(12) United States Patent
Wu

(10) Patent No.: US 9,754,525 B2
(45) Date of Patent: Sep. 5, 2017

(54) DISPLAY PANEL AND DRIVING METHOD THEREOF AND DISPLAY DEVICE

(71) Applicants: BOE TECHNOLOGY GROUP CO., LTD., Beijing (CN); ORDOS YUANSHENG OPTOELECTRONICS CO., LTD., Ordos, Inner Mongolia (CN)

(72) Inventor: Haidong Wu, Beijing (CN)

(73) Assignees: BOE TECHNOLOGY GROUP CO., LTD., Beijing (CN); ORDOS YUANSHENG OPTOELECTRONICS CO., LTD., Ordos, Inner Mongolia (CN)

( * ) Notice: Subject to any disclaimer, the term of this patent is extended or adjusted under 35 U.S.C. 154(b) by 0 days.

(21) Appl. No.: 14/768,919

(22) PCT Filed: Sep. 30, 2014

(86) PCT No.: PCT/CN2014/087899

§ 371 (c)(1),
(2) Date: Aug. 19, 2015

(87) PCT Pub. No.: WO2015/196610

PCT Pub. Date: Dec. 30, 2015

(65) Prior Publication Data

US 2016/0253941 A1 Sep. 1, 2016

(30) Foreign Application Priority Data

Jun. 24, 2014 (CN) ..... 2014 1 0290786

(51) Int. Cl.

| | |
|---|---|
| ***G09G 3/20*** | (2006.01) |
| ***G09G 3/3225*** | (2016.01) |
| ***G09G 3/3208*** | (2016.01) |

(52) U.S. Cl.
CPC ..... *G09G 3/2003* (2013.01); *G09G 3/3208* (2013.01); *G09G 3/3225* (2013.01);
(Continued)

(58) Field of Classification Search
None
See application file for complete search history.

(56) References Cited

U.S. PATENT DOCUMENTS

2005/0073830 A1 4/2005 No
2007/0013647 A1 1/2007 Lee et al.
(Continued)

FOREIGN PATENT DOCUMENTS

CN 1604164 A 4/2005
CN 1896586 A 1/2007
(Continued)

OTHER PUBLICATIONS

Second Chinese Office Action Appln. No. 201410290786.5; Dated Mar. 21, 2016.
(Continued)

*Primary Examiner* — Kenneth B Lee, Jr.
(74) *Attorney, Agent, or Firm* — Ladas & Parry LLP; Loren K. Thompson

(57) ABSTRACT

A display panel and a driving method thereof and a display device are disclosed, and the display panel includes two sets of pixel driving circuits; and, for every two adjacent pixel columns for each primary color, an operating voltage line for one pixel column is connected to a first set of pixel driving circuits via a connection point located at a side of a pixel array where the pixels in the first row of a pixel array are located, and an operating voltage line for the other pixel column which is connected to the second set of pixel driving circuits via a connection point located at a side of the pixel array where the pixels in the last row of the pixel array are
(Continued)

located. The display panel can ensure the uniformity of the display luminance of the whole display panel.

13 Claims, 2 Drawing Sheets

(52) U.S. Cl.
CPC ..... *G09G 2300/0426* (2013.01); *G09G 2300/0452* (2013.01); *G09G 2320/0233* (2013.01)

(56) References Cited

U.S. PATENT DOCUMENTS

2008/0088563 A1 4/2008 Yu et al.
2008/0231575 A1 9/2008 Feng
2011/0128268 A1* 6/2011 Kim ..... G09G 3/3225 345/211
2015/0356928 A1* 12/2015 Xie ..... G09G 3/3225 345/694

FOREIGN PATENT DOCUMENTS

CN 102081903 A 6/2011
CN 103021297 A 4/2013
CN 103794176 A 5/2014
JP 2005-208522 A 8/2005

OTHER PUBLICATIONS

International Search Report & Written Opinion Appln. No. PCT/CN2014/087899; Dated Apr. 3, 2015.
First Chinese office Action Appln. No. 201410290786.5; Dated Oct. 10, 2015.
Third Chinese Office Action dated Aug. 25, 2016; Appln. No. 201410290786.5.

* cited by examiner

DISPLAY PANEL AND DRIVING METHOD THEREOF AND DISPLAY DEVICE

TECHNICAL FIELD

Embodiments of the present disclosure relate to a display panel and a driving method thereof and a display device.

BACKGROUND

Among display devices, organic light-emitting diodes (OLEDs), as current driven type light-emitting devices, have been more and more widely applied to the field of high-performance display, because of characteristics such as self-emission, fast response, wide viewing angle, capability of being made on a flexible substrate, etc.

SUMMARY

According to at least one embodiment of the present disclosure, there is provided an OLED display panel capable of uniforming display luminance and a method for driving the display panel.

According to at least one embodiment of the present disclosure, there is provided a display panel comprising a first set of pixel driving circuits and a second set of pixel driving circuits; and, for every two adjacent pixel columns for each primary color, an operating voltage line for one pixel column is connected to the first set of pixel driving circuits via a connection point located at a side of a pixel array where pixels in a first row of the pixel array are located and an operating voltage line for the other pixel column is connected to the second set of pixel driving circuits via a connection point located at a side of the pixel array where pixels in a last row of the pixel array are located.

According to at least one embodiment of the present disclosure, there is also provided a method for driving a display panel provided with two sets of pixel driving circuits, the method comprising, for every two adjacent pixel columns for each primary color, connecting an operating voltage for one pixel column to a first set of pixel driving circuits via a connection point located at a side of a pixel array where pixels in a first row of the pixel array are located and connecting an operating voltage for the other pixel column to a second set of the pixel driving circuits via a connection point located at a side of the pixel array where pixels in a last row of the pixel array are located; and allowing the operating voltages connected to the two sets of the pixel driving circuits to be equal.

According to at least one embodiment of the present disclosure, there is also provided a display device comprising a display panel as described above.

BRIEF DESCRIPTION OF THE DRAWINGS

In order to clearly illustrate the technical solution of the embodiments of the present disclosure, the drawings of the embodiments will be briefly described in the following; it is obvious that the described drawings are only related to some embodiments of the invention and thus are not limitative of the invention.

DETAILED DESCRIPTION

In order to make objects, technical details and advantages of the embodiments of the invention apparent, the technical solutions of the embodiments will be described in a clearly and fully understandable way in connection with the drawings related to the embodiments of the invention. Apparently, the described embodiments are just a part but not all of the embodiments of the present disclosure. Based on the described embodiments herein, those skilled in the art can obtain all of other embodiments, without any inventive work, which should be within the scope of the invention.

Figure 1:
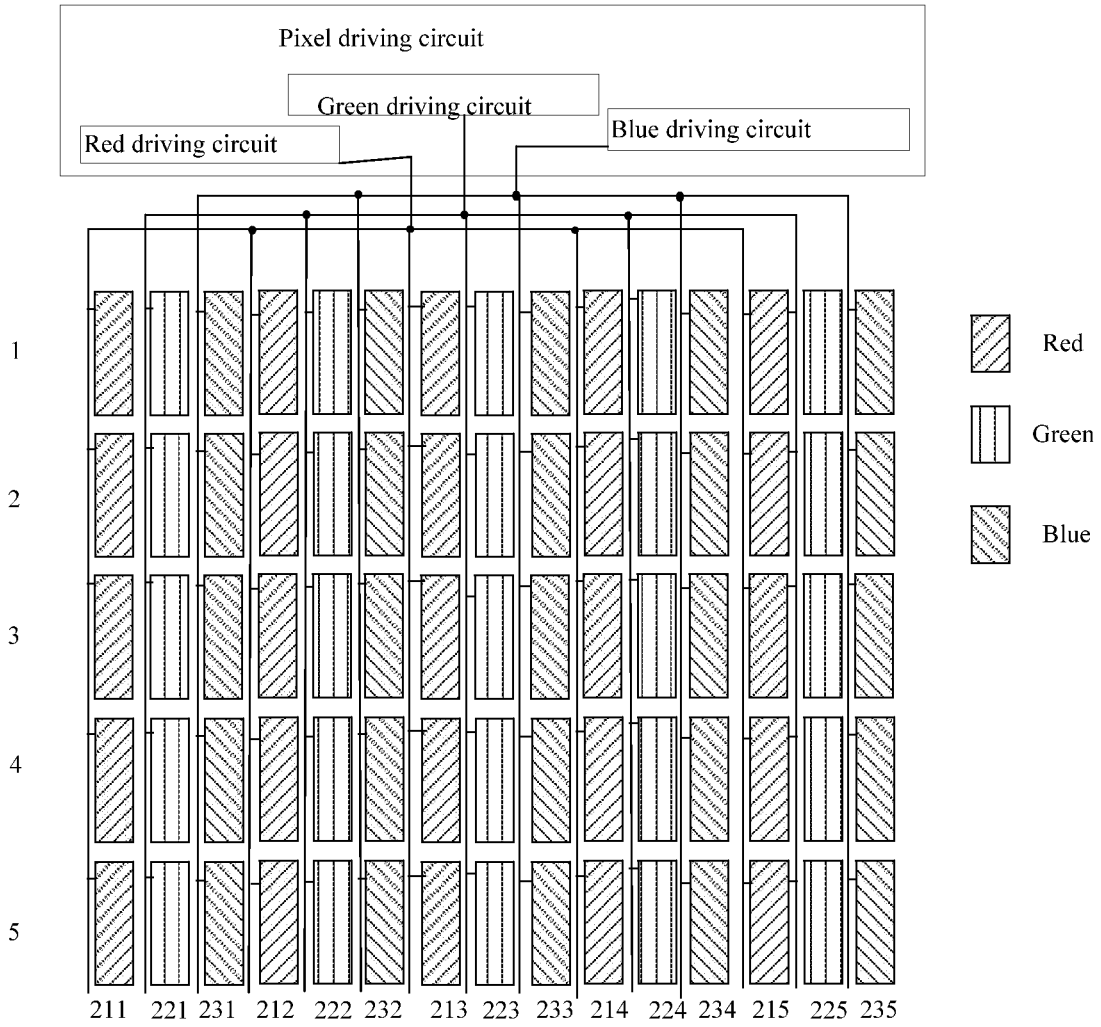
FIG. 1 is a schematic diagram of a configuration of a display panel.

FIG. 1 is a schematic diagram for showing an OLED product, in which circuits for driving pixels (including a red driving circuit, a green driving circuit, and a blue driving circuit) are typically provided on the top of the screen of a display device, and an operating voltage is provided for a pixel compensation circuit of each column of the pixels through an operating voltage line for each column of the pixels. For the OLED product as shown in FIG. 1, the inventor noted that, since the operating voltage lines themselves have certain line resistance which results in a voltage drop to some extent, the pixel units closer to the drive circuits have higher luminance and the pixel units farther away from the driving circuits have lower luminance, which results in a problem with the unevenness of the display luminance.

Figure 2:
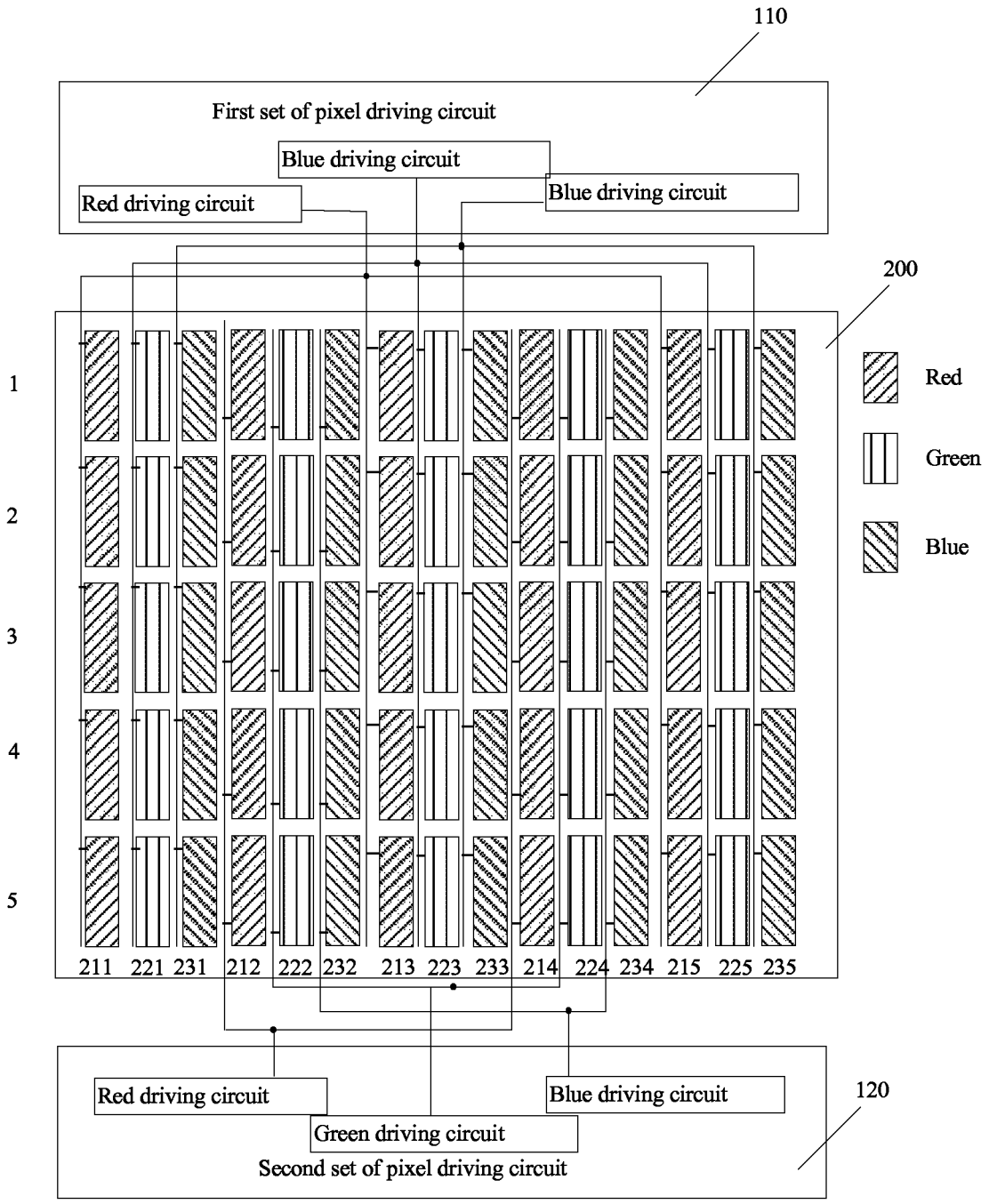
FIG. 2 is a schematic diagram of a configuration of the display panel according to the embodiments of the present disclosure.

According to at least one embodiment of the present disclosure, there is provided a display panel as shown in FIG. 2 which comprises two sets of pixel driving circuits 110 and 120 and an array substrate; a pixel array 200 is formed on the array substrate and the pixel array 200 comprises pixel columns of different primary colors (e.g., red, green, and blue) with each pixel column containing a plurality of sub-pixel units corresponding to the primary color. The example as shown in FIG. 2 involves the case in which 15 columns of pixels are contained and each pixel column comprises 5 rows of sub-pixel units, wherein columns 211-215 are red pixel columns, columns 221-225 are green pixel columns, and columns 231-235 are blue pixel columns; of course, in practices, the number of pixel columns is much larger than 15 and the number of rows is much larger than 5, but the implementation is consistent with that shown in FIG. 2, thus the embodiments of the present disclosure are only explained in conjunction with FIG. 2. For any two adjacent columns of the pixels of each primary color, the operating voltage line, for one pixel column, is connected to the first set of pixel driving circuits 110 via a connection point located at a side of the pixel array where the pixel in the starting row (first row) of the pixel array is located; the operating voltage line, for other pixel column, is connected to the second set of pixel driving circuits 120 via a connection point located at a side of the pixel array where the pixel in the last row (the fifth row) of the pixel array is located. With the red pixel column as an example, the operating voltage lines for the pixel columns 211, 213, and 215 are connected to the pixel driving circuits 110 via connection points located at a side of the pixel array where the pixels in the first row of the pixel array are located, i.e., above the first row of pixels; and the operating voltage lines for the pixel columns 212 and 214 are connected to the pixel driving circuits 120 via connection points located at a side of the pixel array where the pixels in the fifth row of the pixel array are located, i.e., below the fifth row of pixels.

In the embodiments of the present disclosure, the connection method of the operating voltage lines to the pixel compensation circuits for the pixels may be realized by the known method in the art. As shown in FIG. 1 or 2, the pixel compensation circuits for the pixels of a pixel column are connected in parallel to the operating voltage line for the pixel column.

The principles of the embodiments of the present disclosure will be described below in conjunction with FIG. 2, assuming that the two sets of pixel driving circuits are provided with the operating voltages, the initial voltages of which are ELVDD2 and ELVDD1, respectively, and assuming that the operating voltages will drop by ΔV after passing by each pixel; therefore, for all the pixels of the M-th row connected to the first set of pixel driving circuits 110, the operating voltage thereof is ELVDD1−(M−1)ΔV (for example, for the odd-numbered columns of pixels in the figure, the operating voltages for the first, second, third, fourth, and fifth row are ELVDD1, ELVDD1−ΔV, ELVDD1−2ΔV, ELVDD1−3ΔV, and ELVDD1−4ΔV, respectively); accordingly, for all the pixels of the M-th row connected to the second set of pixel driving circuits, the operating voltage thereof is ELVDD2−(5−M)ΔV (for example, for the even-numbered columns of pixels in the figure, the operating voltages for the first, second, third, fourth, and fifth row are ELVDD2−4ΔV, ELVDD2−3ΔV, ELVDD2−2ΔV, ELVDD2−ΔV, and ELVDD2, respectively). Because any two adjacent sub-pixel units with the same color in the row direction are connected to the first set of pixel driving circuits and the second set of pixel driving circuits, respectively, the sum of the operating voltages corresponding to the two adjacent sub-pixel units with the same color is as follows:

$$V0=ELVDD1-(M-1)\Delta V+ELVDD2-(5-M)\Delta V=ELVDD1+ELVDD2-4\Delta V.$$

That is, the sum of the operating voltages for arbitrary two adjacent sub-pixel units with the same color in the row direction is at a fixed value independent of the serial number of the rows. Thus, the sum of the luminance values for arbitrary two adjacent sub-pixel units with the same color in the row direction is maintained at a constant value when the display emits light, which therefore ensures the uniformity of the light-emitting of the display panel.

According to at least one embodiment of the present disclosure, there is provided a display panel comprising two sets of pixel driving circuits; and for every two adjacent pixel columns for each primary color, an operating voltage line, for one pixel column, is connected to the first set of the pixel driving circuits via a connection point located at a side of the pixel array where the pixels in the first row of the pixel array are located, and an operating voltage line, for the other pixel column, is connected to the second set of the pixel driving circuits via a connection point located at a side of the pixel array where the pixels in the last row of the pixel array are located. Thus, for any position in each row, the sum of the distances of any two adjacent pixels of the same primary color to the pixel driving circuits is at a fixed value; because the operating voltage for a pixel finally is determined by the distance to the pixel driving circuit and the sum of the operating voltages for the two adjacent pixels is at a fixed value, the sum of the luminance values of two light-emitting elements corresponding to the any two adjacent pixels of the same primary color is consistent, so that the display luminance of the entire display panel is uniform.

According to at least one embodiment of the present disclosure, as shown in FIG. 2, the first set of pixel driving circuits 110 is set at a side of the pixel array where the pixels in the first row of the pixel array are located, and the second set of pixel driving circuits 120 is set at a side of the pixel array where the pixels in the last row of the pixel array are located.

The advantages of the above arrangement comprise that, on one hand, the driving circuits can be disposed separately to reduce the thickness of the display panel, and on the other hand, the pixel driving circuits can be closer to the driven pixel columns as possible to reduce the voltage drop over a transmission line and then reduce the power consumption.

Understandably, the sum of the operating voltages for two adjacent sub-pixel units with the same primary color in each row is consistent regardless of which position the first pixel driving circuit and the second pixel driving circuit are disposed at. The embodiment of the present disclosure should not be construed as a limitation to the scope of the present disclosure.

According to at least one embodiment of the present disclosure, as shown in FIG. 2, each of the odd-numbered pixel columns for each primary color is connected to the first set of pixel driving circuits 110, and each of the even-numbered pixel columns for each primary color is connected to the second set of pixel driving circuits 120.

In this way, it is possible to achieve the consistency in process and reduce the difficulty for manufacturing the display panel. Of course, in practices, the pixel driving circuits connected to the odd-numbered (even-numbered) columns for each primary color may not be the same. For example, the odd-numbered columns for the red color pixels may be connected to the first pixel driving circuits and the even-numbered columns may be connected to the second pixel driving circuits; also, the odd-numbered columns for the blue color pixels and the green color pixels may be connected to the second pixel driving circuits and the even-numbered columns may be connected to the first pixel driving circuits. The technical solutions of the embodiments of the present disclosure can be achieved as long as the operating voltage lines of two adjacent pixel columns for the same primary color are connected to different pixel driving circuits respectively at the side where the first row of the pixel array is located and the side where the last row of the pixel array is located.

According to at least one embodiment of the present disclosure, as shown in FIG. 2, the display panel includes three primary colors, each set of the pixel driving circuits includes three sub-driving circuits, i.e., a red driving circuit, a green driving circuit, and a blue driving circuit; each sub-driving circuit in the first set of the pixel driving circuits is connected to an operating voltage line of each odd-numbered pixel column for one primary color, and each sub-driving circuit in the second set of the pixel driving circuits is connected to an operating voltage line of each even-numbered pixel column for one primary color.

Of course, in practical applications, the number of the primary colors and the number of sub-driving circuits in each set of the pixel driving circuits may be a greater value N more than three, the technical solutions according to at least one embodiment of the present disclosure may be applied to the display panel with four or more primary colors.

According to at least one embodiment of the present disclosure, the display panel is an active matrix organic light-emitting diode panel or active-matrix organic light-emitting diode (AMOLED) panel.

According to at least one embodiment of the present disclosure, there is also provided a method for driving the display panel provided with two sets of pixel driving circuits, the method comprising:

In Step S1, for every two adjacent pixel columns for each primary color of the display panel, connecting an operating voltage for one pixel column to the first set of the pixel driving circuits via a connection point located at a side of a pixel array where the pixels in the first row of the pixel array are located, and connecting an operating voltage for the other pixel column to the second set of the pixel driving circuits via a connection point located at a side of the pixel array where the pixels in the last row of the pixel array are located.

In Step S2, allowing the operating voltages connected to the two sets of the pixel driving circuits to be equal.

According to at least one embodiment of the present disclosure, for example, for each primary color of the display panel, each of the operating voltages of the odd-numbered pixel columns is connected to the first set of the pixel driving circuits, and each of the operating voltages of the even-numbered pixel columns is connected to the second set of the pixel driving circuits; or, each of the operating voltages of the odd-numbered pixel columns is connected to the second set of the pixel driving circuits, and each of the operating voltages of the even-numbered pixel columns is connected to the first set of pixel driving circuits.

According to at least one embodiment of the present disclosure, there is also provided a display device comprising a display panel as described above.

For example, the display devices according to the embodiments of the present disclosure may be an electronic paper, a mobile phone, a tablet computer, a television, a monitor, a notebook computer, a digital picture frame, a navigator, a watch, any product or component having a display function, etc.

What are described above is related to the illustrative embodiments of the disclosure only and not limitative to the scope of the disclosure; the scopes of the disclosure are defined by the accompanying claims.

This application claims a priority of Chinese patent application no. 201410290786.5 filed on Jun. 24, 2014, which is entirely incorporated by reference herein as a part of this application.

The invention claimed is:

1. A display panel comprising:

a first set of pixel driving circuits and a second set of pixel driving circuits; and a pixel array;

wherein the display panel includes at least three primary colors, the first set of pixel driving circuits includes a first group of sub-driving circuits having one-to-one correspondence with the at least three primary colors, and the second set of pixel driving circuits also includes a second group of sub-driving circuits having one-to-one correspondence with the at least three primary colors; and wherein, for every two adjacent pixel columns for each primary color, an operating voltage line that connects with all sub-pixels of the same primary color in one pixel column is connected to a same sub-driving circuit corresponding to the primary color in the first set of pixel driving circuits via a connection point located at a side of the pixel array where pixels in a first row of the pixel array are located; and another operating voltage line that connects with all sub-pixels of the same primary color in the other pixel column is connected to another same sub-driving circuit corresponding to the primary color in the second set of pixel driving circuits via a connection point located at a side of the pixel array where pixels in a last row of the pixel array are located.

2. The display panel of claim 1, wherein the first set of pixel driving circuits is provided at a side of the pixel array where the pixels in the first row of the pixel array are located, and the second set of pixel driving circuits is set at a side of the pixel array where the pixels in the last row of the pixel array are located.

3. The display panel of claim 1, wherein the operating voltage line of each of odd-numbered pixel columns for each primary color is connected to the first set of pixel driving circuits and the operating voltage line of each of the even-numbered pixel columns for each primary color is connected to the second set of pixel driving circuits; or the operating voltage line of each of even-numbered pixel columns for each primary color is connected to the first set of pixel driving circuits and the operating voltage line of each of the odd-numbered pixel columns for each primary color is connected to the second set of pixel driving circuits.

4. The display panel of claim 1, wherein each sub-driving circuit in the first set of pixel driving circuits is connected to an operating voltage line for each odd-numbered pixel column for one primary color and each sub-driving circuit in the second set of pixel driving circuits is connected to an operating voltage line for each even-numbered pixel column for one primary color.

5. The display panel of claim 4, wherein the at least three primary colors include colors of red, green, and blue, respectively.

6. The display panel of claim 1, wherein the display panel is an active matrix organic light-emitting diode panel.

7. A method for driving a display panel provided a first set of pixel driving circuits, a second set of pixel driving circuits, and a pixel array, the method comprising:

for every two adjacent pixel columns for each primary color, connecting an operating voltage that connects with all sub-pixels of the same primary color in one pixel column to a same sub-driving circuit corresponding to the primary color in the first set of pixel driving circuits via a connection point located at a side of the pixel array where pixels in a first row of the pixel array are located, and connecting another operating voltage that connects with all sub-pixels of the same primary color in the other pixel column to another same sub-driving circuit corresponding to the primary color in the second set of pixel driving circuits via a connection point located at a side of a pixel array where pixels in a last row of the pixel array are located; and allowing the operating voltages connected to the first and second sets of the pixel driving circuits to be equal.

8. The method of claim 7, wherein, for each primary color of the display panel, the operating voltage of each of odd-numbered pixel columns is connected to the first set of pixel driving circuits and the operating voltage of each of the even-numbered pixel columns is connected to the second set of pixel driving circuits; or the operating voltage of each of even-numbered pixel columns is connected to the first set of pixel driving circuits and the operating voltage of each of the odd-numbered pixel columns is connected to the second set of pixel driving circuits.

9. A display device comprising the display panel of claim 1.

10. The display panel of claim 3, wherein each sub-driving circuit in the first set of pixel driving circuits is connected to the operating voltage line for each odd-numbered pixel column for one primary color and each sub-driving circuit in the second set of pixel driving circuits is connected to the operating voltage line for each even-numbered pixel column for one primary color.

11. The display panel of claim 10, wherein the at least three primary colors include colors of red, green, and blue, respectively.

12. The display panel of claim 1, wherein corresponding operating voltage lines for pixel columns of each primary color are alternately connected to the first set of pixel driving circuits and the second set of pixel driving circuits.

13. The display panel of claim 1, wherein:

the at least three primary colors includes at least a first primary color, a second primary color and a third primary color;

the first group of sub-driving circuits includes at least a first sub-driving circuit corresponding to the first primary color, a second sub-driving circuit corresponding to the second primary color, and a third sub-driving circuit corresponding to the third primary color;

the second group of sub-driving circuits includes at least a fourth sub-driving circuit corresponding to the first primary color, a fifth sub-driving circuit corresponding to the second primary color, and a sixth sub-driving circuit corresponding to the third primary color;

for every two adjacent pixel columns for the first primary color, an operating voltage line that connects with all sub-pixels of the first primary color in one pixel column is connected to the first sub-driving circuit, and another operating voltage line that connects with all sub-pixels of the first primary color in the other pixel column is connected to the fourth sub-driving circuit;

for every two adjacent pixel columns for the second primary color, an operating voltage line that connects with all sub-pixels of the second primary color in one pixel column is connected to the second sub-driving circuit, and another operating voltage line that connects with all sub-pixels of the second primary color in the other pixel column is connected to the fifth sub-driving circuit; and for every two adjacent pixel columns for the third primary color, an operating voltage line that connects with all sub-pixels of the third primary color in one pixel column is connected to the third sub-driving circuit, and another operating voltage line that connects with all sub-pixels of the third primary color in the other pixel column is connected to the sixth sub-driving circuit.

* * * * *